US006776241B2

(12) United States Patent
Castano-Mears et al.

(10) Patent No.: US 6,776,241 B2
(45) Date of Patent: Aug. 17, 2004

(54) SCREEN JACKET ASSEMBLY CONNECTION AND METHODS OF USING SAME

(75) Inventors: Ana M. Castano-Mears, Coppell, TX (US); Ralph H. Echols, Dallas, TX (US); Perry Carter Shy, Southlake, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/283,918

(22) Filed: Oct. 30, 2002

(65) Prior Publication Data

US 2003/0056959 A1 Mar. 27, 2003

Related U.S. Application Data

(63) Continuation of application No. 09/602,387, filed on Jun. 22, 2000, now Pat. No. 6,530,431.

(51) Int. Cl.[7] ..... E21B 43/10

(52) U.S. Cl. ..... 166/381; 166/227; 166/236; 166/242.6

(58) Field of Search ..... 166/227, 230, 166/233, 235, 236, 242.6, 381

(56) References Cited

U.S. PATENT DOCUMENTS

| | | | | | |
|---|---|---|---|---|---|
| 4,416,331 | A | * | 11/1983 | Lilly | 166/236 |
| 4,742,872 | A | * | 5/1988 | Geske | 166/231 |
| 5,992,518 | A | * | 11/1999 | Whitlock | 166/235 |
| 6,382,318 | B1 | * | 5/2002 | Whitlock | 166/278 |
| 6,530,431 | B1 | * | 3/2003 | Castano-Mears et al. | 166/381 |

* cited by examiner

*Primary Examiner*—Zakiya Walker
(74) *Attorney, Agent, or Firm*—Peter V. Schroeder

(57) ABSTRACT

Disclosed are apparatus and methods for movably securing a radially expandable sand-control screen jacket assembly to a base pipe. The screen jacket assembly is connected to the base pipe with a longitudinally moveable, sand-controlling joint. In use, the joint slides maintain a sand-controlling seal after radial expansion of the sand-control screen jacket assembly.

8 Claims, 4 Drawing Sheets

SCREEN JACKET ASSEMBLY CONNECTION AND METHODS OF USING SAME

CROSS REFERENCE TO RELATED APPLICATIONS

This application is a continuation of U.S. patent application Ser. No. 09/602,387 filed on Jun. 22, 2000, now U.S. Pat. No. 6,530,431.

TECHNICAL FIELD

The present inventions relate to sand-control apparatus for use in subterranean wells, and in particular contemplate improved mechanical apparatus for attaching a sand-control screen jacket assembly to a base pipe and methods of using the same.

BACKGROUND OF THE INVENTIONS

The control of the movement of sand and gravel into a well bore has been the subject of much importance in the oil production industry. The introduction of sand or gravel into the wellbore commonly occurs under certain well conditions. The introduction of these materials into the well commonly causes problems including plugging and erosion. There have therefore been numerous attempts to prevent the introduction of sand and gravel into the production stream.

A common method to prevent the introduction of sand and gravel into the production stream has been a procedure known as gravel packing. In general, this involves placing a selected sand or gravel into the annular space between the wellbore and a base pipe introduced into the wellbore for that purpose. The base pipe contains perforations designed to allow well fluids to flow into the base pipe while excluding other material. A sand-control screen is commonly used in conjunction with a base pipe. An appropriately sized screen is commonly formed into a jacket and wrapped around the outside of the base pipe to prevent the entry of sand. Exemplary apparatus and methods of connecting a sand-control screen jacket assembly to a base pipe are disclosed in U.S. Pat. No. 5,931,232, which is assigned to this assignee and is incorporated herein for all purposes by this reference thereto.

One method of enhancing production in a well using a sand-control screen jacket assembly includes causing the radial expansion of the base pipe and surrounding screen jacket assembly by drawing a mechanical expansion tool through the base pipe. The radial expansion of the screen jacket assembly and base pipe is known to cause a related shrinkage in the length of both the base pipe and the screen jacket assembly. Since the base pipe is concentrically enclosed by the screen jacket assembly, the mechanical expander deployed in the base pipe necessarily causes greater expansion in the base pipe than in the surrounding screen jacket assembly. Correspondingly, the base pipe undergoes a greater contraction in length relative to the screen jacket assembly. This differential change in length causes problems such as cracking at the junction between the screen jacket assembly and the base pipe and can lead to the introduction of sand and gravel into the production stream.

Due to the aforementioned problems with the introduction of sand and gravel into the production stream, a need exists for apparatus and methods providing a robust mechanical sand-controlling, longitudinally moveable connection between a sand-control screen jacket assembly and a base pipe. Such a connection should withstand downhole production conditions including radial expansion and the related differential longitudinal contraction of the base pipe and sand-control screen jacket assembly.

SUMMARY OF THE INVENTIONS

In general, the inventions provide apparatus and methods for connecting a sand-control screen jacket assembly to a base pipe while providing for longitudinal movement of the screen jacket assembly relative to the base pipe.

The apparatus employs a substantially tubular screen jacket assembly having a first ring affixed to at least one end. A second ring is affixed to the outer surface of the base pipe of the screen jacket assembly wherein the first and second rings have sand-controllingly overlapping portions defining a longitudinally movable joint. The joint has a stop integral with the overlapping portions of the first and second rings, which prevents the possibility of longitudinal separation of the screen shroud and base pipe.

According to one aspect of the invention the stop comprises a plurality of corresponding screws and slots in the respective overlapping portions of the first and second rings.

According to another aspect of the invention, the stop comprises correspondingly opposed surfaces of the respective overlapping portions of the first and second rings.

According to yet another aspect of the invention, the ring affixed to the base pipe is attached by a plurality of fasteners such as set screws.

According to still other aspects of the invention, the screen jacket assembly has one or more longitudinally deformable pleats or slots.

According to another aspect of the invention, the screen jacket assembly has one or more radially expandable pleats.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
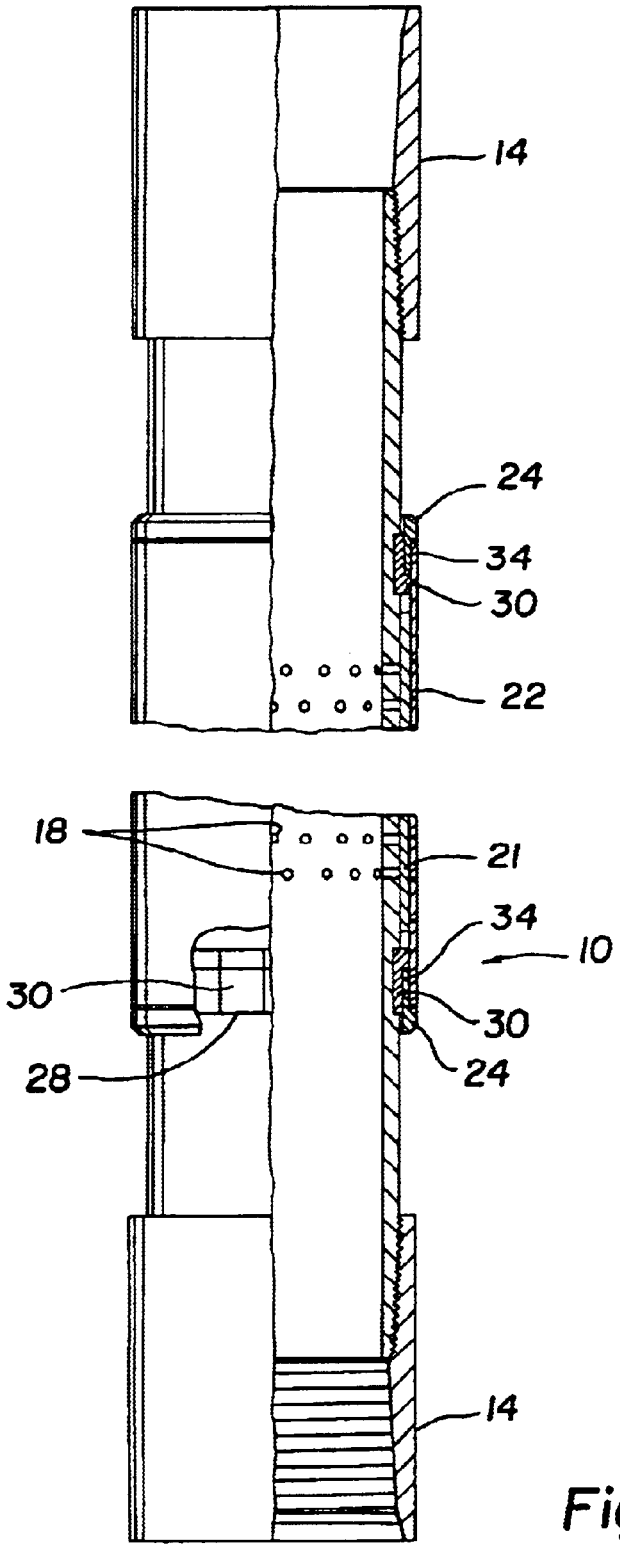
FIG. 1 is a longitudinal cross-sectional view of a sand-control screen jacket assembly mechanically connected to a base pipe.

The present inventions are described by reference to drawings showing one or more examples of how the inventions can be made and used. In these drawings, reference characters are used throughout the several views to indicate like or corresponding parts.

In the description which follows, like or corresponding parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole", "longitudinally" and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal orientation. "Longitudinally moveable", in particular, means movement with a longitudinal component, although a transverse component may be present as well. In the discussion which follows generally cylindrical well, pipe and tube components are assumed unless expressed otherwise. The term "sand-control" used herein means the exclusion of particles larger in cross section than a chosen size, whether sand, gravel, mineral, soil, organic matter, or a combination thereof.

Referring now to FIGS. 1 through 9 the general structure of a sand-control screen jacket assembly connection 10 utilizing the present inventive concepts is shown. It will be obvious to those skilled in the arts that the opposite end (not shown) of the screen jacket assembly 20 may be constructed in any conventional manner or in the same manner as the end described. A base pipe 12 is threadably connected to a collar 14 at either end. Each collar 14 is in turn connected to a pipe string (not shown) used in a subterranean well. The base pipe 12 has a plurality of perforations 18 through which fluids in the well enter the interior of the base pipe 12. The number and configuration of the perforations 18 is not critical to the invention so long as a balance between fluid production and pipe integrity is maintained. A sand-control screen jacket assembly 20 concentrically surrounds the base pipe 12. The sand-control screen jacket assembly 20 has one or more concentric screens 21, with or without a layer of packed sand between concentric screen layers, and typically, a surrounding screen shroud 22. The exact configuration of the screen jacket assembly is not critical to the invention and may be varied by those skilled in the arts according to well conditions. For example, the number and mesh sizes of screen may be varied, or the shroud may be omitted entirely. The screen jacket assembly may be radially expandable. Some examples of variations in the configuration of the screen, shroud, and screen jacket assembly, are further discussed below.

Figure 2:
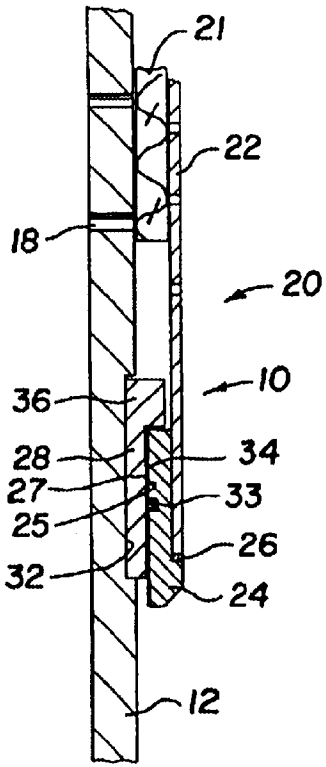
FIG. 2 is a close-up longitudinal cross-sectional view of another example of an embodiment of a sand-control screen jacket assembly mechanically connected to a base pipe.

The preferred embodiment of the invention shown with an unexpanded screen jacket assembly in FIG. 2 has a substantially tubular screen shroud 22 with a first ring 24 affixed to one end, preferably by a weld 26. A second ring 28 is affixed to the outer surface of the base pipe 12, also preferably by a weld 26. In this embodiment, the second ring 28 is preferably made of a plurality of segments 30 (FIG. 1) captured in a groove 32 provided for this purpose in the base pipe 12. The first and second rings 24, 28 have respective overlapping portions 25, 27. The corresponding overlapping portions 25, 27 define a longitudinally slidable joint 34 sufficiently close-fitting to exclude sand particles of a size to also be excluded by the screen 21, but not necessarily fluid tight. As the base pipe 12 and screen jacket assembly 20 are radially expanded with corresponding differential changes in length, the overlapping portions 25, 27 of the joint 34 slide longitudinally with respect to one another while maintaining their sand-controlling fit. An elastomeric seal element 33 may be inserted at slidable joint 34. The longitudinal separation of the screen jacket assembly 20 and the base pipe 12 is prevented by a stop 36, preferably an integral portion of the second ring 28.

Figure 3:
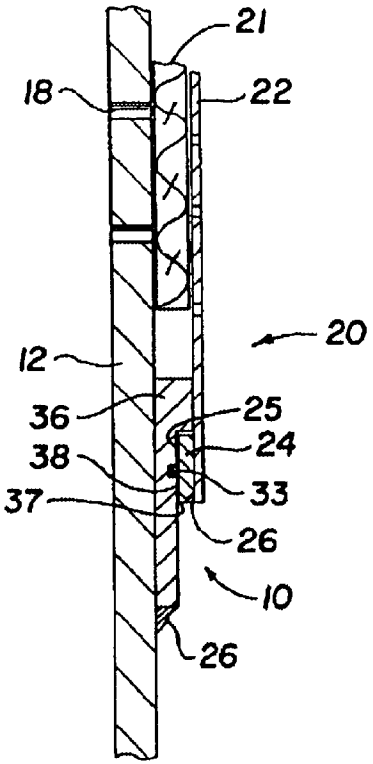
FIG. 3 is a close-up longitudinal cross-sectional view of yet another example of an embodiment of a sand-control screen jacket assembly mechanically connected to a base pipe.

FIG. 3 depicts an example of another embodiment of an apparatus using the invention. The screen jacket assembly connection 10 in FIG. 3 has a substantially tubular screen shroud 22 with a first ring 24 affixed to one end, preferably by a weld 26. The embodiment using the invention depicted in FIG. 3 has a second ring 38 attached to the base pipe 12 with a weld 26. Additionally, the groove 32 of FIG. 2 is omitted from the embodiment of FIG. 3. An alternative configuration of the first ring 24 is also shown in FIG. 3. The first and second rings 24, 38 have respective overlapping portions 25, 37. The corresponding overlapping portions 25, 37 define a longitudinally slidable joint 34 sufficiently close-fitting to exclude sand particles of a size to also be excluded by the screen 21, but not necessarily fluid tight. As the base pipe 12 and screen jacket assembly 20 are radially expanded with corresponding differential changes in length, the overlapping portions 25, 37 of the joint 34 slide longitudinally with respect to one another while maintaining their sand-controlling fit. An elastomeric seal element 33 may be inserted at slidable joint 34. The longitudinal separation of the screen jacket assembly 20 and the base pipe 12 is prevented by a stop 36, preferably an integral portion of the second ring 38.

Figure 4:
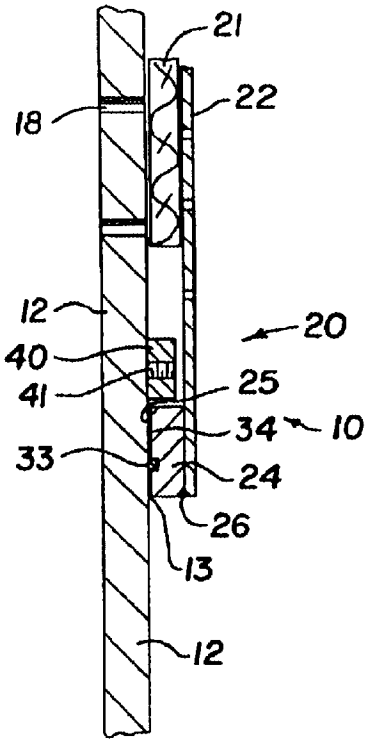
FIG. 4 is a close-up longitudinal cross-sectional view of still another example of an embodiment of a sand-control screen jacket assembly mechanically connected to a base pipe.

FIG. 4 depicts an example of another embodiment of an apparatus using the invention. The embodiment shown in FIG. 4 has a substantially tubular screen shroud 22 with a first ring 24 affixed to one end, preferably by a weld 26. A second ring 40 is attached to the base pipe 12 with a plurality of set screws 41. A longitudinally slidable joint 34 is defined by the inner surface 25 of the first ring 24 and the corresponding outer surface 13 of the base pipe 12. The longitudinally slidable joint 34 is sufficiently close-fitting to exclude sand particles of a size to also be excluded by the screen 21, but not necessarily fluid tight. As the base pipe 12 and screen jacket assembly 20 are radially expanded with corresponding differential changes in length, the overlapping portions 25, 13 of the joint 34 slide longitudinally with respect to one another while maintaining their sand-controlling fit. An elastomeric seal element 33 may be inserted at slidable joint 34. The longitudinal separation of the screen jacket assembly 20 and the base pipe 12 is prevented by the stop 36 defined by the transverse alignment of the first ring 24 and second ring 40.

Figure 5:
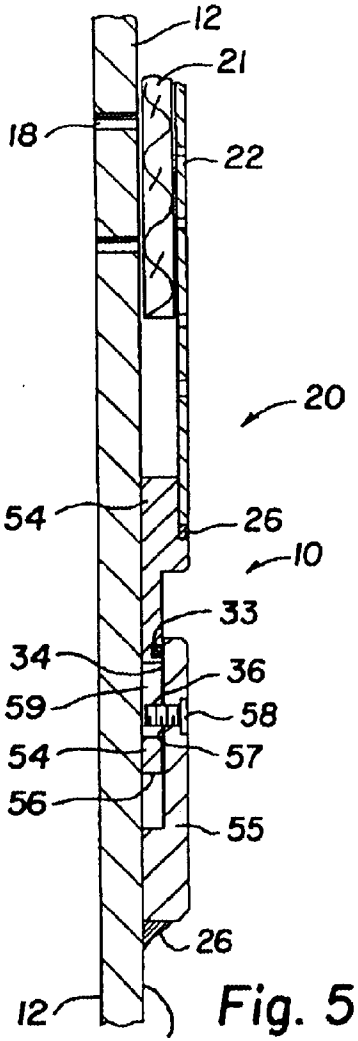
FIG. 5 is a close-up longitudinal cross-sectional view of an example of an embodiment of a sand-control screen jacket assembly mechanically connected to a base pipe.

An alternative embodiment using the invention is shown in FIG. 5. A substantially tubular screen shroud 22 has a first ring 54 affixed to one end, preferably by a weld 26. Alternatively, the first ring 54 may be integral to shroud 22. A second ring 55 is affixed to the outer surface of the base pipe 13, also preferably by a weld 26. The first and second rings 54, 55 have respective overlapping portions 56, 57. The corresponding overlapping portions 56, 57 define a longitudinally slidable joint 34 sufficiently close-fitting to exclude sand particles of a size to also be excluded by the screen 21, but not necessarily fluid tight. As the base pipe 12 and screen jacket assembly 20 are radially expanded with corresponding differential changes in length, the overlapping portions 56, 57 of the joint 34 slide longitudinally with respect to one another while maintaining their sand-controlling fit. An elastomeric seal element 33 may be inserted at slidable joint 34. The longitudinal separation of the screen jacket assembly 20 and the base pipe 12 is prevented by stop assembly 36, preferably made from a plurality of corresponding screws 58 and slots 59 in the respective overlapping portions 56, 57 of the first and second rings 54, 55.

Figure 6:
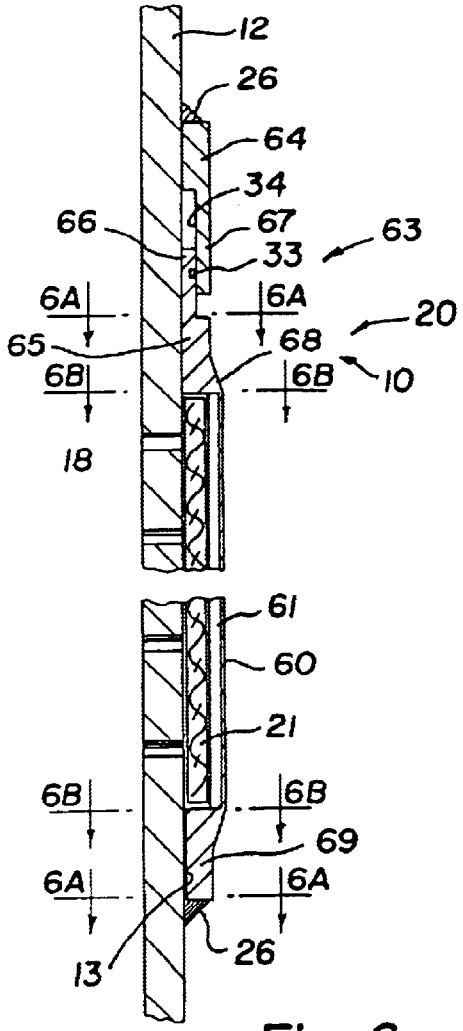
FIG. 6 is a close-up longitudinal cross-sectional view of an example of an embodiment of a sand-control screen jacket assembly mechanically connected to a base pipe.
Figure 6A:
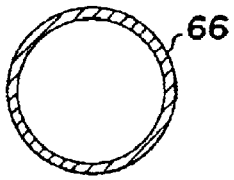
FIG. 6A is a transverse cross-sectional view taken along line A—A of FIG. 6.
Figure 6B:
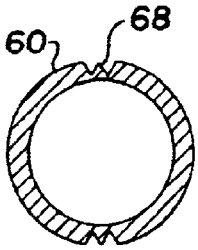
FIG. 6B is a transverse cross-sectional view taken along line B—B of FIG. 6.

FIG. 6 illustrates an alternative embodiment using the invention. The screen 21 has longitudinal pleats 61 to facilitate radial expansion. More extensive pleats or corrugations may also be provided for added surface area. As in the embodiments described with reference to FIGS. 1–5, the embodiment of FIG. 6 may be used with screen jacket assemblies 20 made with various combinations of screen 21 layers and a screen shroud 60. The embodiment has an end connection assembly 63 with a first ring 64 welded to the base pipe 12. A second ring 65 has a captured portion 66 captured between an overlapping portion 67 of the first ring and the base pipe 12. The corresponding overlapping portions 66, 67 define a longitudinally slidable joint 34 sufficiently close-fitting to exclude sand particles of a size to also be excluded by the screen 62, but not necessarily fluid tight. As the base pipe 12 and screen jacket assembly 20 are radially expanded with corresponding differential changes in length, the overlapping portions 66, 67 of the joint 34 slide longitudinally with respect to one another while maintaining their sand-controlling fit. An elastomeric seal element 33 may be inserted at slidable joint 34. The second ring 65 has an integral transition portion 68 welded to the screen jacket assembly 20. As can best be seen in FIG. 6A, taken in cross section along line A—A of FIG. 6, the captured portion 66 of the second ring 65 is cylindrical in cross section where it meets the base pipe 12. FIG. 6B, taken in cross-section along line B—B of FIG. 6, illustrates that the transition portion 68 of the second ring is pleated or corrugated in cross-section where it is welded to the screen jacket assembly 20. A third ring 69 having a transition portion substantially similar to that of the second ring 65 may be welded to the opposite, preferably downhole, end of the screen jacket assembly 20 and the surface 13 of the base pipe 12. Alternatively, both ends of the screen jacket assembly may employ an end connection assembly 63.

It will be clear to those skilled in the art that the structure shown and described with referrence to rings 65, 66 or 69 in FIG. 6 can be adapted for the use of longitudinally pleated screens or shrouds in combination with any of the above-described embodiments shown and discussed with reference to FIGS. 1–5.

Figure 7:
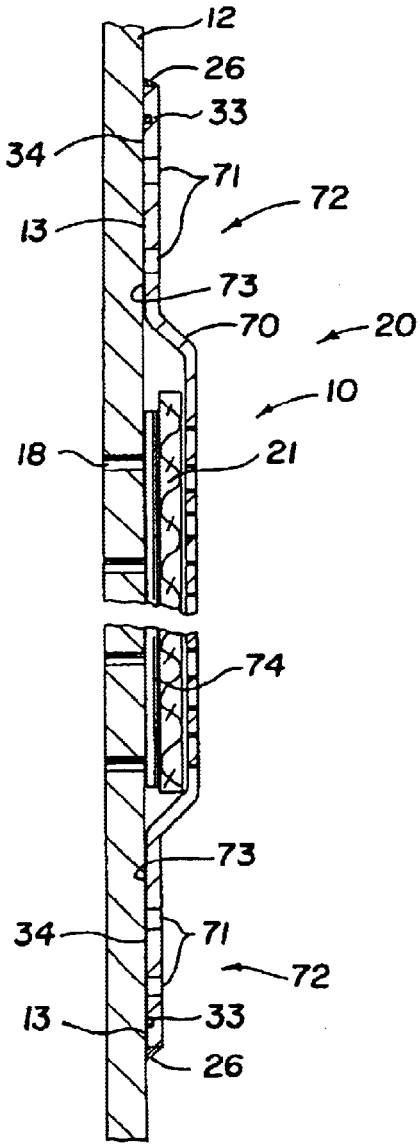
FIG. 7 is a close-up longitudinal cross-sectional view of an example of another embodiment of a sand-control screen jacket assembly connected to a base pipe.

FIG. 7 depicts yet another alternative embodiment of a screen shroud 70 using the invention. This embodiment incorporates longitudinally deformable slots 71 in the screen shroud 70. Of course, the embodiment shown and described may be used with a screen jacket assembly made with various combinations of screen and screen shroud layers. The shroud 70 is welded 26 at its end portions 72 to the base pipe 12. The inner surface 73 of the end portions 72 of the shroud 70 containing the transverse slots 71 is in flush contact with the outer surface 13 of the base pipe 12. The transverse slots 71 are designed to facilitate longitudinal movement of the shroud 70 relative to the base pipe 12 defining a longitudinally, deformably slidable joint 34 sufficiently close-fitting to exclude sand particles of a size to also be excluded by the screen 21, but not necessarily fluid tight. As the base pipe 12 and screen jacket assembly 20 are radially expanded with corresponding differential changes in length, the transverse slots 71 of the joint 34 deform longitudinally while maintaining their sand-controlling fit. An elastomeric seal element 33 may be inserted at slidable joint 34. As in the other embodiments described herein, a screen 21 is captured between the shroud 70 and the base pipe 12. Of course, the exact orientation and location of the slots is not critical to the invention so long as the slots are configured to incorporate the property of longitudinal movability, for example, helical slots may be used. Optionally, spacer rods 74 may be included between the screen 21 and base pipe 12 to facilitate fluid flow.

Figure 8:
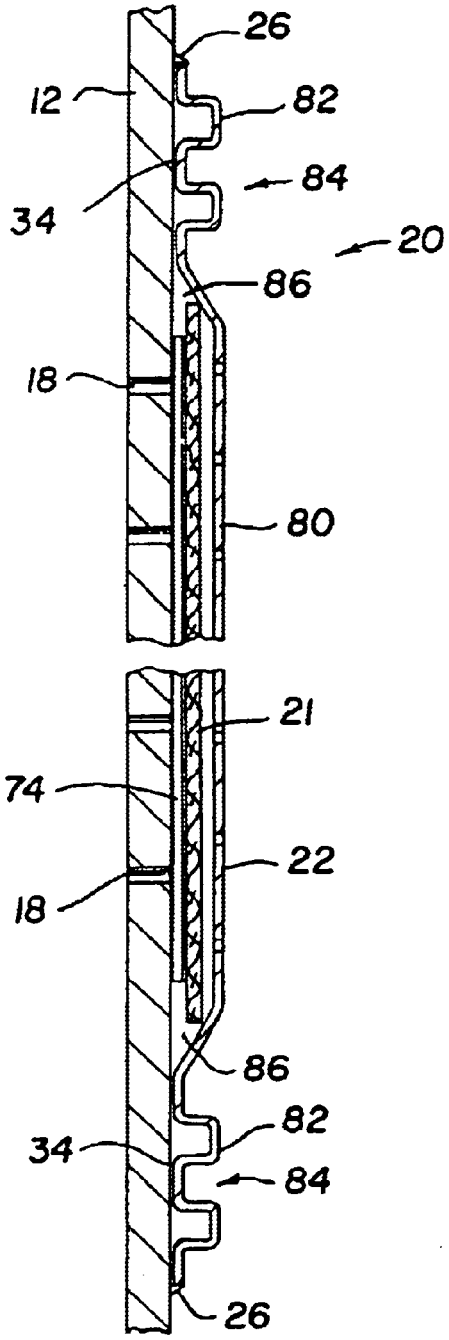
FIG. 8 is a close-up longitudinal cross-sectional view of an example of another embodiment of a sand-control screen jacket assembly connected to a base pipe.
Figure 9:
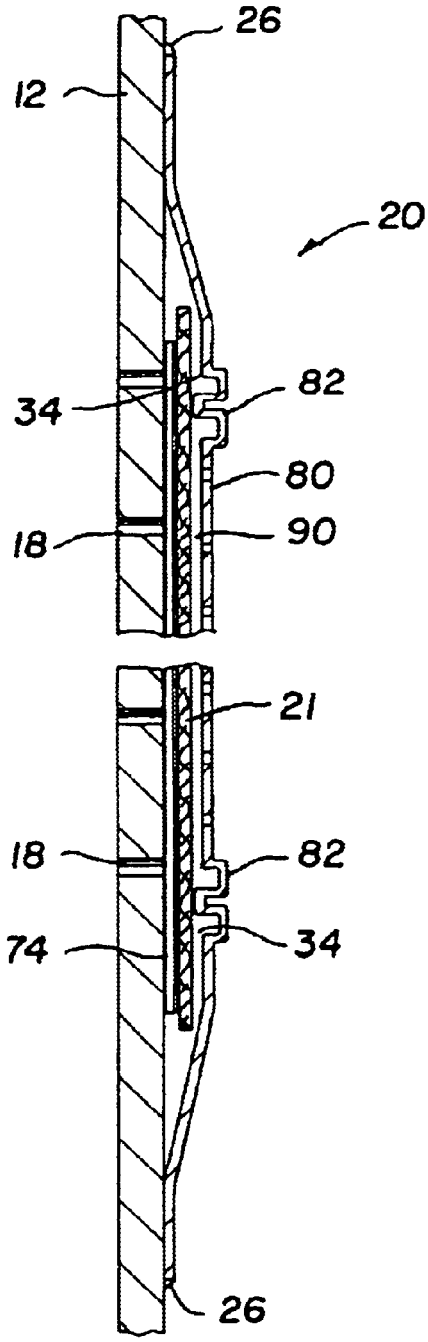
FIG. 9 is a close-up longitudinal cross-sectional view of an example of another embodiment of a sand-control screen jacket assembly connected to a base pipe.

FIGS. 8 and 9 depict other alternative embodiments using the invention with a screen jacket assembly 20 having a screen shroud 80 concentrically surrounding one or more screens 21. The screen shroud 80 has one or more longitudinally deformable pleats 82. The exact orientation and location of the pleats 82 is not critical to the invention so long as the pleats are configured to incorporate the property of longitudinal deformability, for example, transverse pleats 82 or helical pleats may be used. The pleated screen shroud 80 shown is welded 26 to the base pipe at either end 84, capturing the screen 21 and allowing space 86 for sliding movement at the ends 84. The pleats 82 may be arranged on the shroud 80 overlapping the screen 21, as shown in FIG. 9, such that the pleats 82 act as a spacer, maintaining fluid flow space 90 between the screen shroud 80 and screen 21.

Further referring to FIGS. 8–9, the pleats 82 are designed to facilitate longitudinal movement of the shroud 80 relative to the base pipe 12 defining a longitudinally, deformably slidable joint 34 sufficiently close-fitting to exclude sand particles of a size to also be excluded by the screen 21, but not necessarily fluid tight. As the base pipe 12 and screen jacket assembly 20 are radially expanded with corresponding differential changes in length, the pleats 82 of the shroud 80 deform longitudinally while maintaining their sand-controlling fit. As in the other embodiments described herein, a screen 21 is captured between the shroud 80 and the base pipe 12. Of course, the exact orientation and location of the pleats is not critical to the invention so long as the pleats are configured to incorporate the property of longitudinal deformability, for example, helical pleats may be used. Optionally, spacer rods 74 may be included between the screen 21 and base pipe 12 to facilitate fluid flow.

The embodiments shown and described above are only exemplary. Many details are often found in the art such as: screen mesh size, configurations and materials, the use of longitudinal rods or other spacers between a screen and another surface, or the use of a packed sand layer between screen layers. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. An apparatus for sand-control in a subterranean well comprising:

a radially expandable base pipe having an outer surface, the pipe designed for mechanically-induced permanent deformation;

a radially expandable screen jacket assembly disposed about the base pipe, the screen jacket having a screen shroud; and a sand-controlling joint slidably connecting the screen shroud to the outer surface of the base pipe, the joint having longitudinally deformable slots therein.

2. An apparatus as in claim 1 wherein the slots run laterally about the screen shroud.

3. An apparatus as in claim 1 wherein the sand-controlling joint comprises a base pipe joint member attached to the base pipe and a shroud joint member attached to the screen shroud, the joint members in sand-controlling slidable engagement with one another.

4. An apparatus as in claim 3 wherein the longitudinally deformable slots are formed on the shroud joint member.

5. A method of sand-control in a subterranean well comprising the steps of:

placing a radially expandable screen jacket assembly connected to a radially expandable base pipe with a longitudinally slidable sand-control joint into the well, the sand-control joint having longitudinally deformable slots therein to facilitate expansion; and mechanically radially expanding the screen jacket assembly and base pipe.

6. A method as in claim 5 wherein the slots are laterally oriented.

7. A method as in claim 5 wherein the sand-controlling joint comprises a base pipe joint member attached to the base pipe and a shroud joint member attached to the screen shroud, the joint members in sand-controlling slidable engagement with one another.

8. A method as in claim 7 wherein the longitudinally deformable slots are formed on the shroud joint member.

* * * * *